US007954267B2

(12) United States Patent
Anzalone

(10) Patent No.: US 7,954,267 B2
(45) Date of Patent: Jun. 7, 2011

(54) HOLDER FOR DISPLAYING A SHEET OF MATERIAL

(76) Inventor: Michael Joseph Anzalone, Centereach, NY (US)

( * ) Notice: Subject to any disclaimer, the term of this patent is extended or adjusted under 35 U.S.C. 154(b) by 397 days.

(21) Appl. No.: 11/529,042

(22) Filed: Sep. 28, 2006

(65) Prior Publication Data

US 2007/0180747 A1 Aug. 9, 2007

Related U.S. Application Data

(60) Provisional application No. 60/765,063, filed on Feb. 3, 2006.

(51) Int. Cl.
*G09F 1/12* (2006.01)

(52) U.S. Cl. ..... 40/756; 40/611.06; 40/790

(58) Field of Classification Search ..... 40/765, 40/611.05–611.07, 585, 709, 759
See application file for complete search history.

(56) References Cited

U.S. PATENT DOCUMENTS 1,894,803 A * 1/1933 Wahlstrom ..... 40/759
2,176,535 A 10/1939 Markoff
3,142,920 A * 8/1964 Nelson et al. ..... 40/122
3,741,548 A * 6/1973 Kaupp ..... 273/157 R
3,838,529 A * 10/1974 Aybar ..... 40/585
3,981,092 A * 9/1976 Ramsdale ..... 40/709
4,187,630 A * 2/1980 Giulie et al. ..... 40/790
4,672,758 A * 6/1987 Le-Carpentier et al. ..... 40/766
4,679,341 A * 7/1987 Goldman ..... 40/611.06
5,189,822 A * 3/1993 Schmanski et al. ..... 40/611.05
5,335,434 A * 8/1994 Shultz et al. ..... 40/766
5,911,525 A * 6/1999 Jepsen et al. ..... 40/611.06
6,006,459 A * 12/1999 Kosmach ..... 40/200
6,316,073 B1 * 11/2001 Hiscock et al. ..... 428/68
D451,555 S 12/2001 Smith
6,374,523 B1 * 4/2002 Smith ..... 40/611.06
6,553,704 B1 * 4/2003 Pigg ..... 40/734
6,986,422 B2 * 1/2006 Boatwright ..... 206/449
7,055,275 B1 * 6/2006 Teza et al. ..... 40/735
7,266,920 B2 * 9/2007 Kao ..... 40/800

OTHER PUBLICATIONS

Swiss Re design drawings dated Nov. 16, 1996 (1 page).
Mancini-Duffy Architectural Design (1 page).

* cited by examiner

*Primary Examiner* — Joanne Silbermann
*Assistant Examiner* — Shin Kim
(74) *Attorney, Agent, or Firm* — Carter, DeLuca, Farrell & Schmidt, LLP

(57) ABSTRACT

A holder for displaying a sheet of material includes a bracket having a back surface configured for mounting to a support surface, a slidably removable front plate defining a display area, and an insertably removable back plate. The bracket includes a plurality of protrusion members extending therefrom configured to be insertably received by a corresponding number of openings defined within the back plate to enable attachment to the bracket. The back plate is insertably received within the bracket by a recess formed therein and is supported within the bracket by a plurality of extensions projecting therefrom. The front plate is slidably received within the bracket by a recess formed therein. Replacements of varying color and/or tint are included for the front plate and back plate to allow for interchangeability.

27 Claims, 9 Drawing Sheets

HOLDER FOR DISPLAYING A SHEET OF MATERIAL

PRIORITY

This patent application claims priority to a provisional patent application filed on Feb. 3, 2006 and assigned U.S. Provisional Application Ser. No. 60/765,063; the entire contents of which are incorporated herein by reference.

BACKGROUND

1. Technical Field

The present disclosure relates to display devices. More particularly, the present disclosure relates to a holder for displaying interchangeable sheets of material including display components which can be removably inserted into the holder for enabling a plurality of display options.

2. Background of the Related Art

When displaying information such as, for example, an advertising display, display holders are used to receive the advertising material therein. One requirement for these holders is that they must be able to firmly secure the material received within the holder. However, it is necessary to be able to quickly and easily change or replace the display material in the holder, for example when advertising material needs to be updated. It is also necessary to quickly and easily change the display/retaining area of the holder that may have been damaged during use or to alter the appearance of the display, e.g., the tint or color of the display area through which advertising material is viewed. Problems with known display holders are that it may be difficult to do this.

It is accordingly an aspect of the present disclosure to provide a holder suitable for displaying a sheet of material which overcomes the problems noted above.

SUMMARY

A holder for displaying a sheet of material is disclosed having a removable back plate and a removable front plate adjacent the removable back plate for supporting the sheet of material within a recess defined therebetween. The front plate defines a display area for viewing the sheet of material therethrough. The back plate and front plate are supported within a bracket configured for mounting the holder to a support surface such as a wall or door.

According to another embodiment of the present disclosure, a holder for displaying a sheet of material is provided having a bracket comprised of a header member and footer member, which define a groove for slidably receiving the front plate therebetween. A back plate is included for mounting the holder to a support surface such as a wall or door. The back plate attaches to the header member and footer member in a slide-fit or snap-fit manner within a track formed on the back side thereof. At least one locking member may be included on the bracket to engage the front plate to secure the front plate into a plurality of positions, e.g. in an open position to allow for interchangeability of the sheet of material or a closed position to allow for viewing of the sheet of material therethrough. A through-hole may be included for receiving a fastening member to engage the locking member to move it towards the front plate to lock it into one of a plurality of positions.

Both embodiments of the present disclosure can be packaged as a kit having several brackets, several removable back plates, and several removable front plates. The front plates and/or the back plates can be different colors, tints, etc. to enable replacement thereof with another front plate and/or back plate from the kit. Additionally, multiple size variations are envisioned, vertical and horizontal dimensions of the bracket, front plate, back plate, etc.

BRIEF DESCRIPTION OF THE DRAWINGS

Particular embodiments of the presently disclosed holder are described herein with reference to the drawings, wherein.

DETAILED DESCRIPTION OF THE PREFERRED EMBODIMENTS

Figure 1:
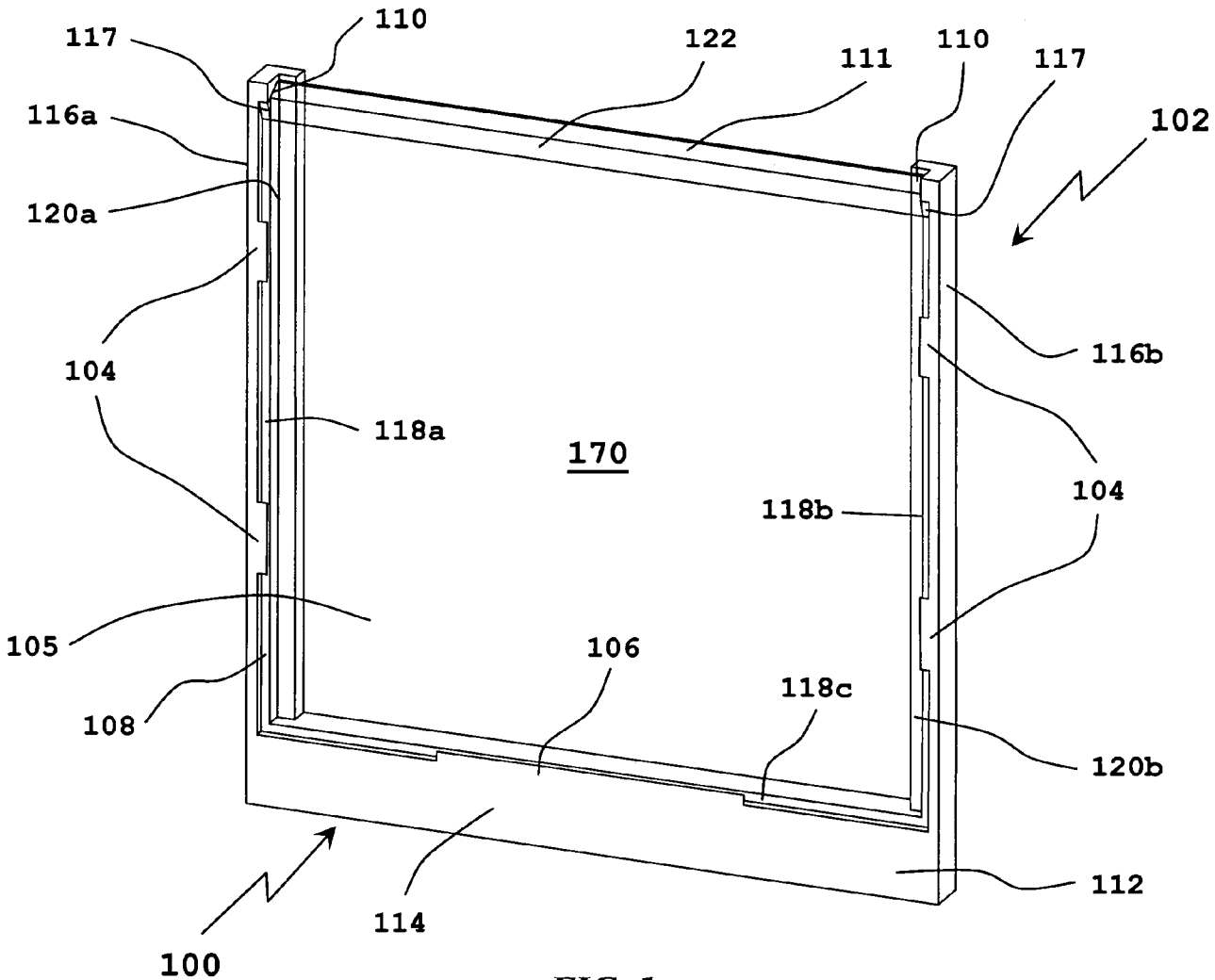
FIG. 1 shows a perspective view of one embodiment of a holder for displaying a sheet of material, in accordance with the principles of the present disclosure.

The preferred embodiments of the presently disclosed holder are described below in detail with reference to the drawings, in which like reference numerals designate identical or corresponding elements in each of the several views.

Referring to FIG. 1, there is shown a holder for displaying a sheet of material therein according to one embodiment of the present disclosure generally identified by reference numeral 100. Holder 100 includes a U-shaped bracket 102 ("bracket 102") having a base portion 114 and a pair of spaced legs 116*a* and 116*b* for holding a sheet of material 170. The bracket 102 is configured to be mounted to a support surface (not shown) such as a wall or a door via an adhesive material, screw, brackets or the like. For example, the bracket 102 may be mounted to the support surface using conventional methods such as using double-sided adhesive strips having a first surface adhered to the back surface 112 of the bracket 102 and a second surface adhered to the support surface. Alternately, other techniques can be used to mount the bracket 102 to a support surface, e.g., screws, nails, interlocking structure, hook and loop fasteners, etc.

The holder 100 further includes a removable and generally transparent front plate 111 configured to be slidably received into an open end defined in the bracket 102, e.g., along a major recess 110 defined between legs 116*a* and 116*b* of the bracket 102. The major recess 110 includes a track portion

120*a* and 120*b* formed in each leg 116*a* and 116*b*, respectively, of the bracket 102. Each track portion 120*a* and 120*b* faces and is generally aligned with the other track portion 120 and 120*b*. The front plate 111 may be generally square in shape and constructed of any one of several clear or transparent materials as is necessary for viewing the sheet of material 170 therethrough. Alternately, other configurations are envisioned, rectangular, polygonal, etc. Examples of such materials include glass, plastic, etc. The material may also be magnified or opaque depending upon a particular purpose.

The holder 100 further includes a back plate 105 configured to be removable from the bracket 102. While inserted within the bracket 102, the back plate 105 is positioned substantially adjacent to the front plate 111 such that the back plate 105 and the front plate 111 define a recess 122 for receiving the sheet of material 170 therebetween. The back plate 105 is configured to be insertably received into the bracket 102 within a minor recess 108 defined in the base portion 114 and legs 116*a* and 116*b* of the bracket 102. The minor recess 108 also includes a track portion 118*c* in the base portion 114 and track portions 118*a* and 118*b* in each leg 116*a* and 116*b*, respectively, of bracket 102. Each leg 116*a* and 116*b* includes an indent 117 defined at one end of the legs 116*a* and 116*b* opposite the base portion 114. The indents 117 are recessed from the back surface 112 of the bracket 102 towards the track portions 118*a* and 118*b* of the legs 116*a* and 116*b*. The length of each track portion 118*a* and 118*b* in the legs 116*a* and 116*b* extends from the base portion 114 at one end of the legs 116*a* and 116*b* to the indents 117 at the opposite end. Track portion 118*a* is parallel to track portion 118*b*, and track portions 118*a*, 118*b* are perpendicular with track portion 118*c* in the base portion 114. The track portion 118*c* within the base portion 114 extends from the track portion 118*a* in one leg 116*a* to the track portion 118*b* in the leg 116*b*. In use, the back plate 105 is prevented from sliding within the minor recess 108 in an upward direction by the indents 117 and in a downward direction by the base portion 114.

It should be understood that relative to the minor recess 108, the major recess 110 is defined within the bracket 102 further in proximity from the rear surface 112, with the minor recess 108 being defined between the rear surface 112 and the major recess 110. The back plate 105 may be generally square in shape and constructed of various materials including, for example, plastic injection molding, metal, etc. Alternately, the back plate 105 may be constructed of a bendable material such as appropriate types of plastic or the like to allow warping and/or bowing to facilitate insertion of the back plate 105 within the minor recess 108.

The bracket 102 further includes a plurality of minor retaining extensions 104 projecting therefrom for supporting the back plate 105 within the minor recess 108. As can be seen in FIG. 1, the minor extensions 104 can be flush with the back surface 112 of the bracket 102, such that the minor extensions 104 project inwardly towards each other from one side of the bracket 102 to the other to engage the back plate 105 and prevent displacement of the back plate 105 from the minor recess 108.

The bracket 102 further includes at least one major retaining extension 106 projecting therefrom for providing additional support of the back plate 105 within the minor recess 108. As can be seen in FIG. 1, the major extension 106 can be flush with the back surface 112 of the bracket 102 and projects inward towards an upper end of the bracket 102 to engage the back plate 105 and prevent displacement of the back plate 105 from the minor recess 108.

Additionally, the holder 100 can be packaged as a kit having bracket 102, several removable front plates 111, and several removable back plates 105. The removable back plates 105 can have different colors, including multi-color and clear as shown by FIG. 1, for enabling a user to be able to remove one back plate 105 and replace it with another back plate 105 from the kit. The kit can also contain several front plates 111, each having a different tint or color, including clear, transparent, or opaque. The sheet of material 170 provided between the removable back plate 105 and the front plate 111 may have indicia thereon (not shown), such as text, symbols, logos, etc., capable of being viewed through the front plate 111.

Figure 2:
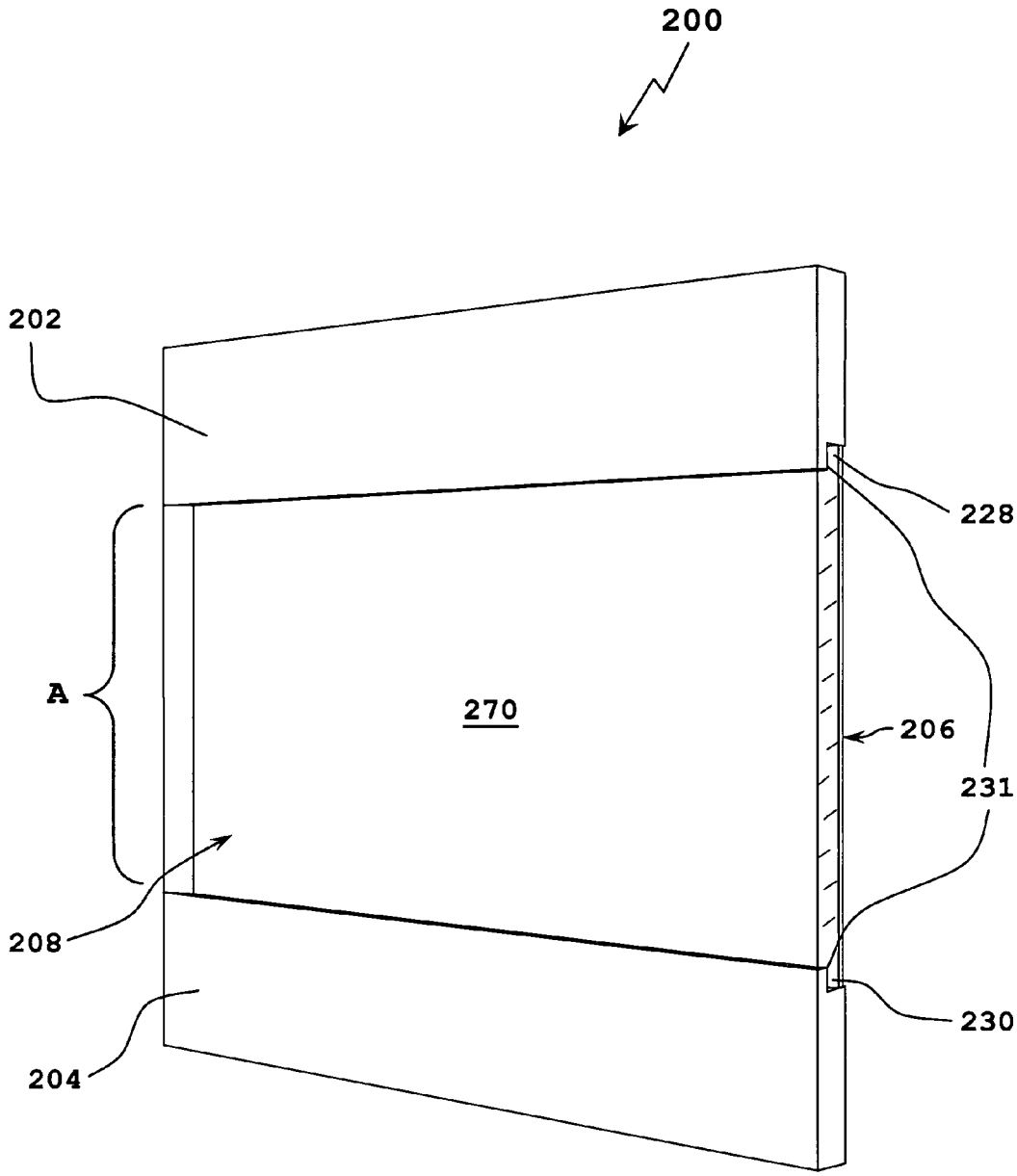
FIG. 2 shows a perspective view of an alternate embodiment of a holder for displaying a sheet of material, in accordance with the principles of the present disclosure.

Referring now to FIGS. 2-9, there is shown a holder for displaying a sheet of material 270 therein according to another embodiment of the present disclosure generally identified by reference numeral 200. As shown in FIG. 2, the holder 200 includes a display area A which is defined by a front plate 208 through which a sheet of material 270 is viewed. The front plate 208 may be generally square in shape and constructed from any one of several clear or transparent materials as is necessary for viewing the sheet of material therethrough.

Figure 5:
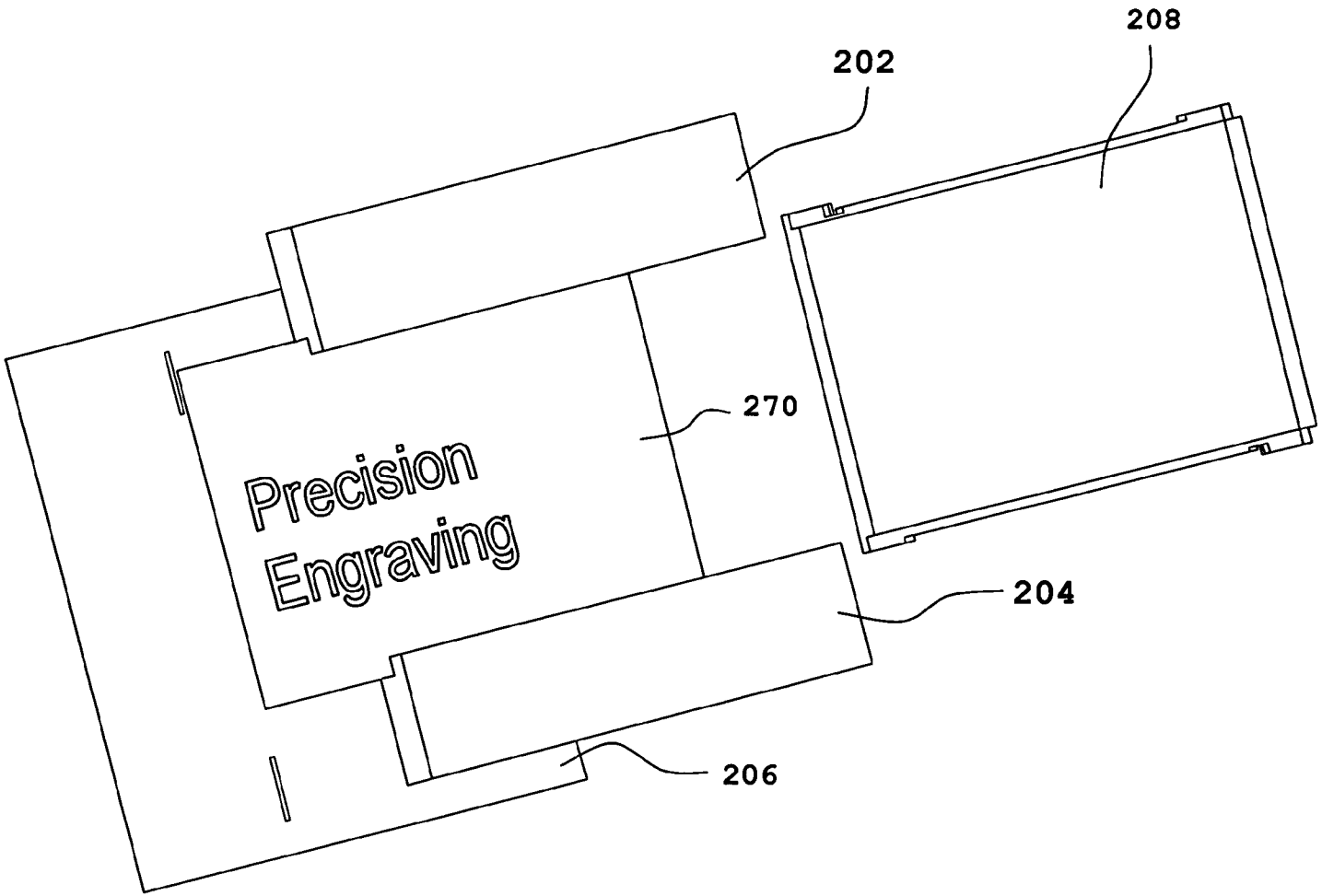
FIG. 5 shows an exploded perspective view of the holder shown in FIG. 2 with the back plate and front plate completely removed from the bracket, and the sheet of material partially removed from the bracket.

The holder 200 further includes a back plate 206 for mounting to a support surface (not shown) as described above. As can be seen in FIG. 5, the back plate 206 may be removed from the holder 200 to enable changing of the back plate 206 and/or the sheet of material 270. The back plate 206 is shown in detail in FIGS. 3 and 8 and includes a plurality of openings 212 configured to enable attachment of the back plate 206 to the holder 200.

The holder 200 further comprises a header member 202 and a footer member 204 configured to support the front plate 208 therebetween. As can be seen in FIG. 2, a first track portion 228 defined by the header member 202 and a second track portion 230 defined by the footer member 204 combine to form a first track 231 for slidably receiving the front plate 208 therebetween.

Figure 6:
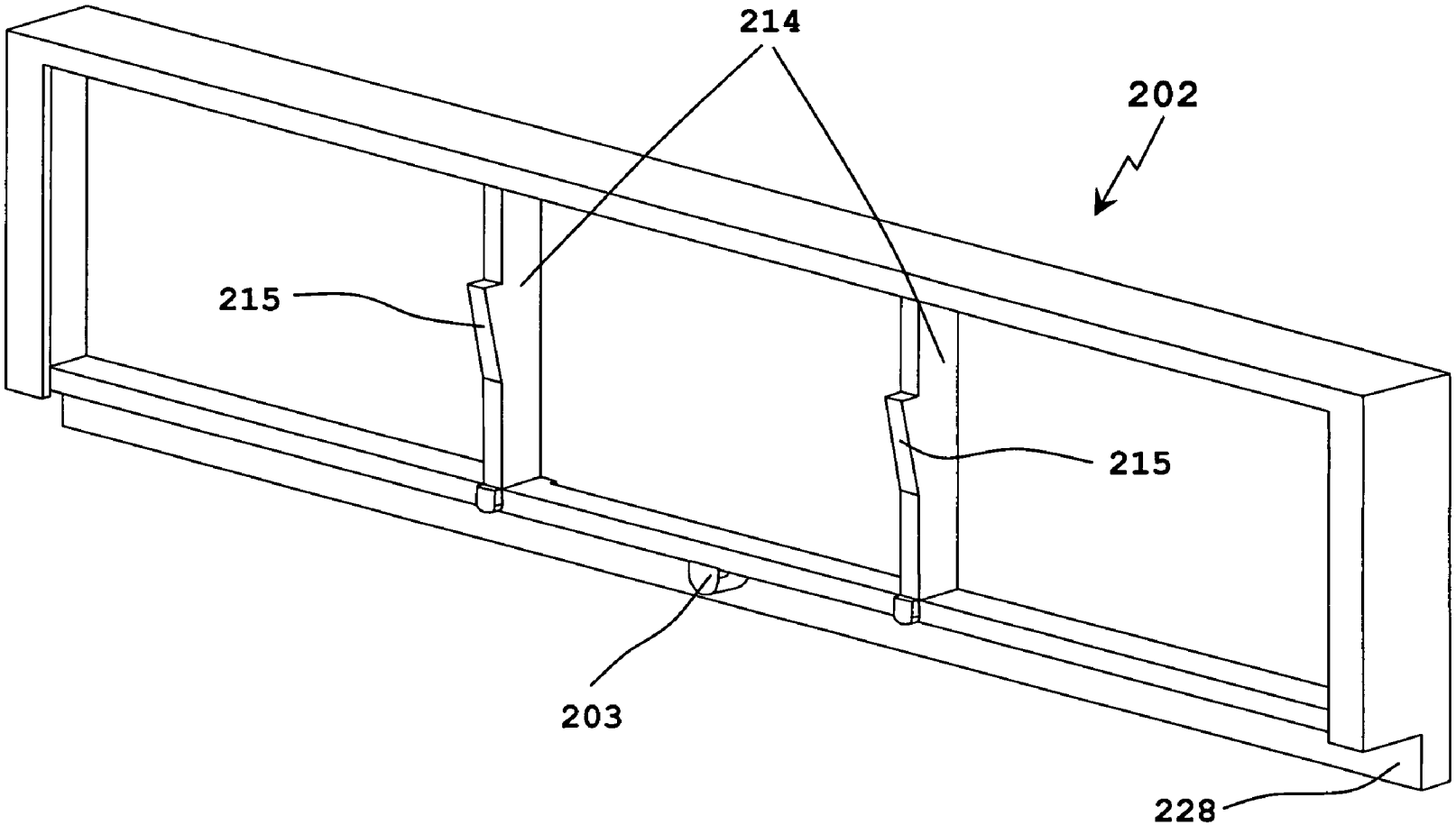
FIG. 6 shows a back perspective view of the header member of the bracket shown in FIG. 2, illustrating a first locking member and one or more protrusion members included thereon.
Figure 7:
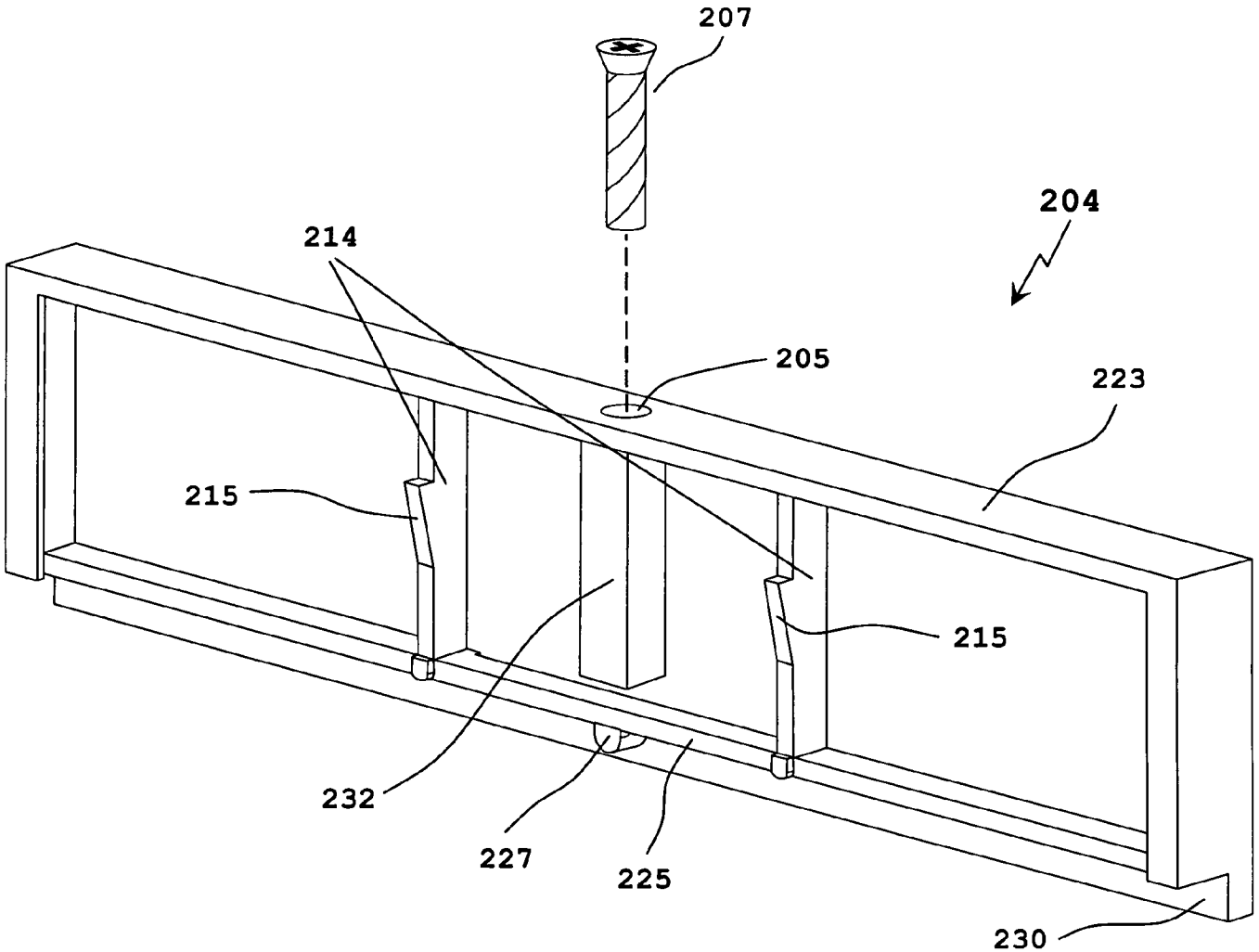
FIG. 7 shows a back perspective view of the footer member of the bracket shown in FIG. 2, illustrating a fastening member removed from a through-hole defined in a support positioned between upper and lower cross braces.

The header member 202 and footer member 204 each include a plurality of protrusion members 214 protruding from the back thereof, as shown in FIGS. 6-7. The protrusion members 214 can be shaped in a way to include extensions 215 angled outward therefrom to form an edge generally normal to the surface thereof, as can be seen in FIGS. 6-7. In use, the extensions 215 align with the openings 212 on the back plate 206 and are insertably received therein. For example, the openings 212 may be longitudinal cut-outs within the back plate 206 which are configured to align with and receive the extensions 215 in a snap-fit or slide-fit manner. Once secured within the openings 212, the edge of the extensions 215 normal to the surface of the protrusion members 214 prevent the back plate 205 from sliding along the protrusion members 214 in a downward or upward direction.

Figure 3:
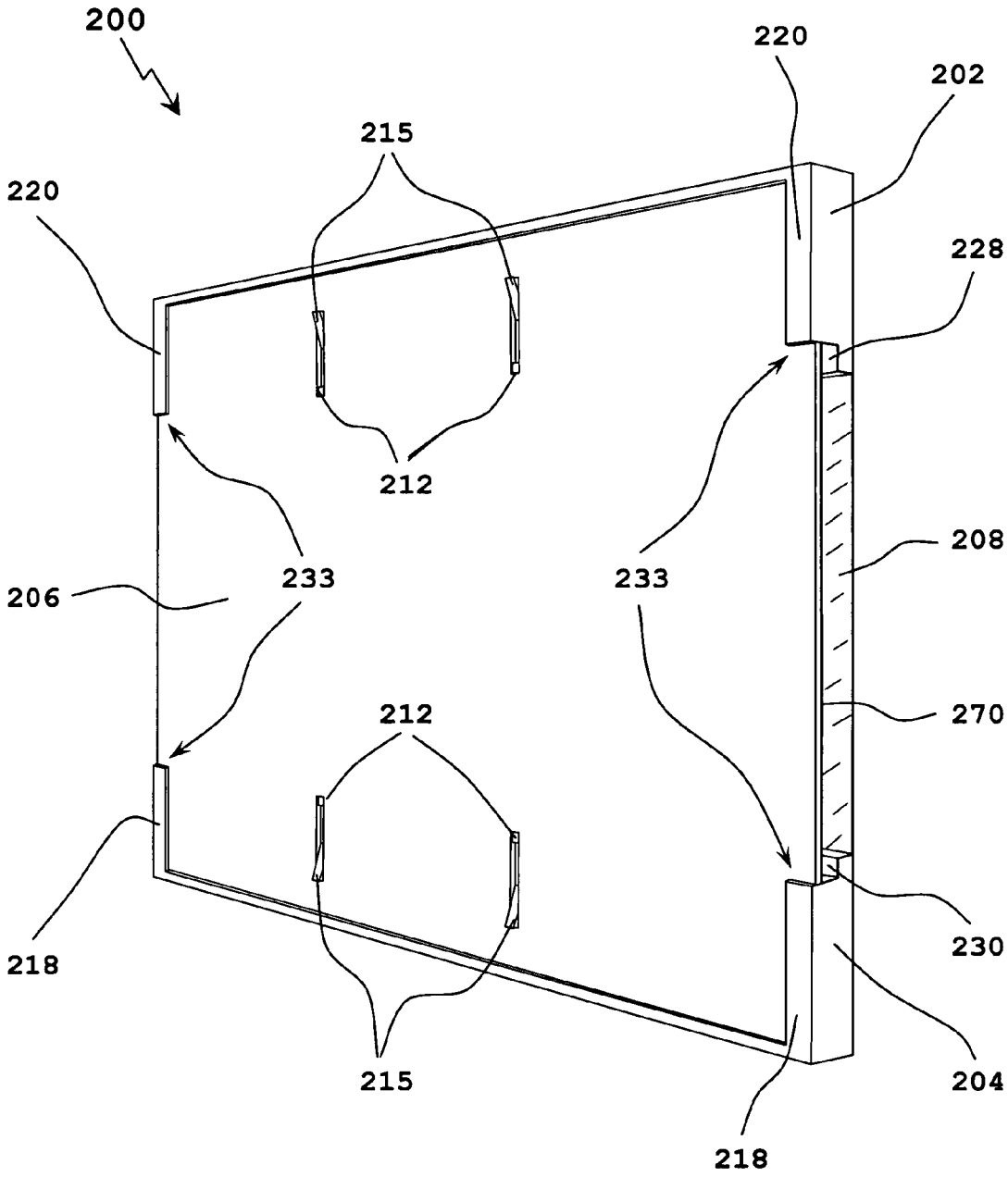
FIG. 3 shows a rear perspective view of the holder shown in FIG. 2 illustrating a back plate attached to header and footer members of a bracket.

The back plate 206 is additionally supported by the header member 202 and the footer member 204 via a first pair of flanges 218 and a second pair of flanges 220 positioned on the back thereof. The first and second pair of flanges 218, 220 form a second track 233 for inserting the back plate 206 therein, as shown in FIG. 3. It is understood that the protrusion members 214 are slide-fit or snap-fit into the openings 212, as discussed above, to secure the back plate 206 within the second track 233 to form the holder 200 shown in FIG. 2. In this manner, the holder 200 is then configured to slidably receive the front plate 208 and the sheet of material 270 therein.

Figure 4:
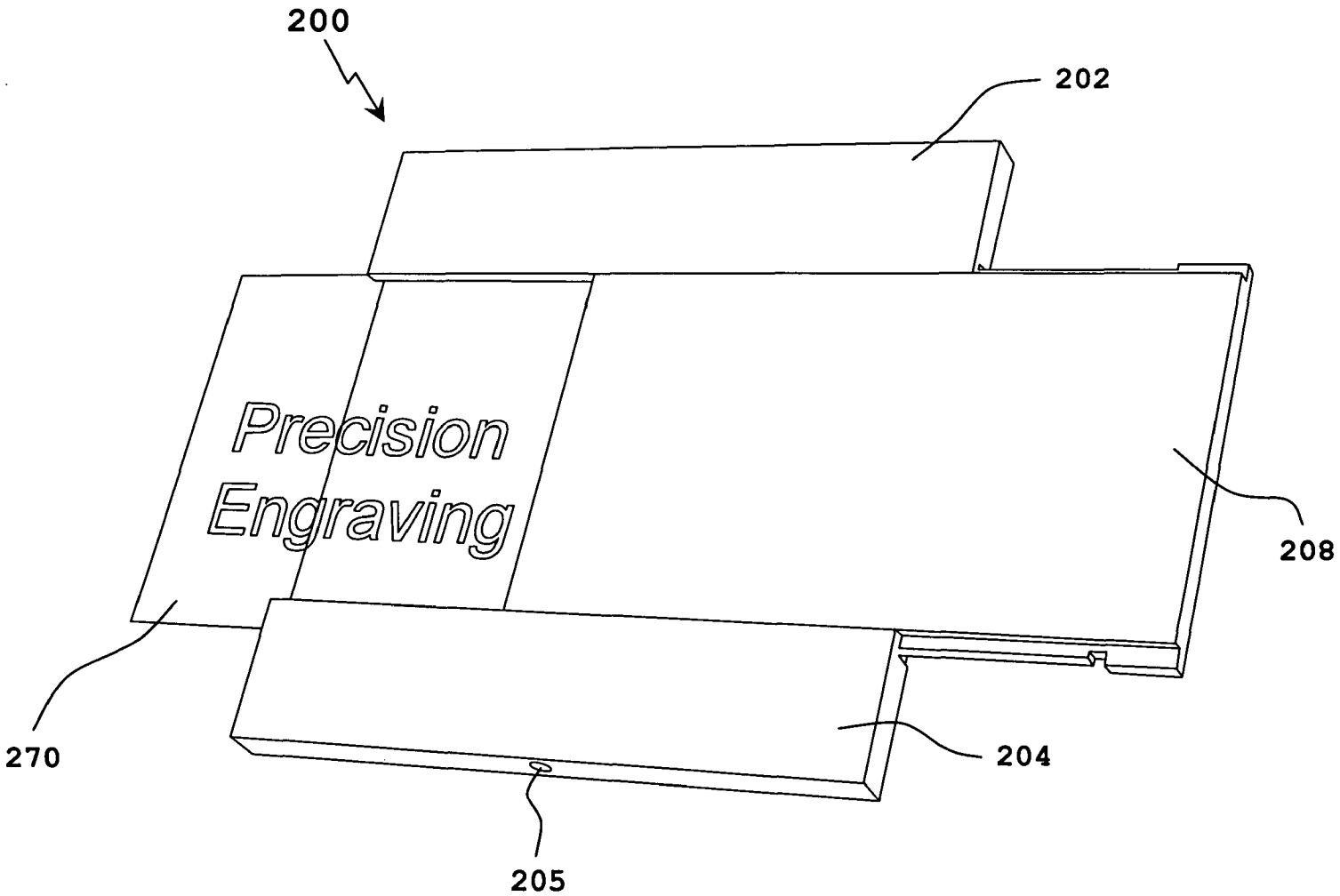
FIG. 4 shows a perspective view of the holder shown in FIG. 2 illustrating a removable front plate and the sheet of material partially removed from the bracket.
Figure 9:
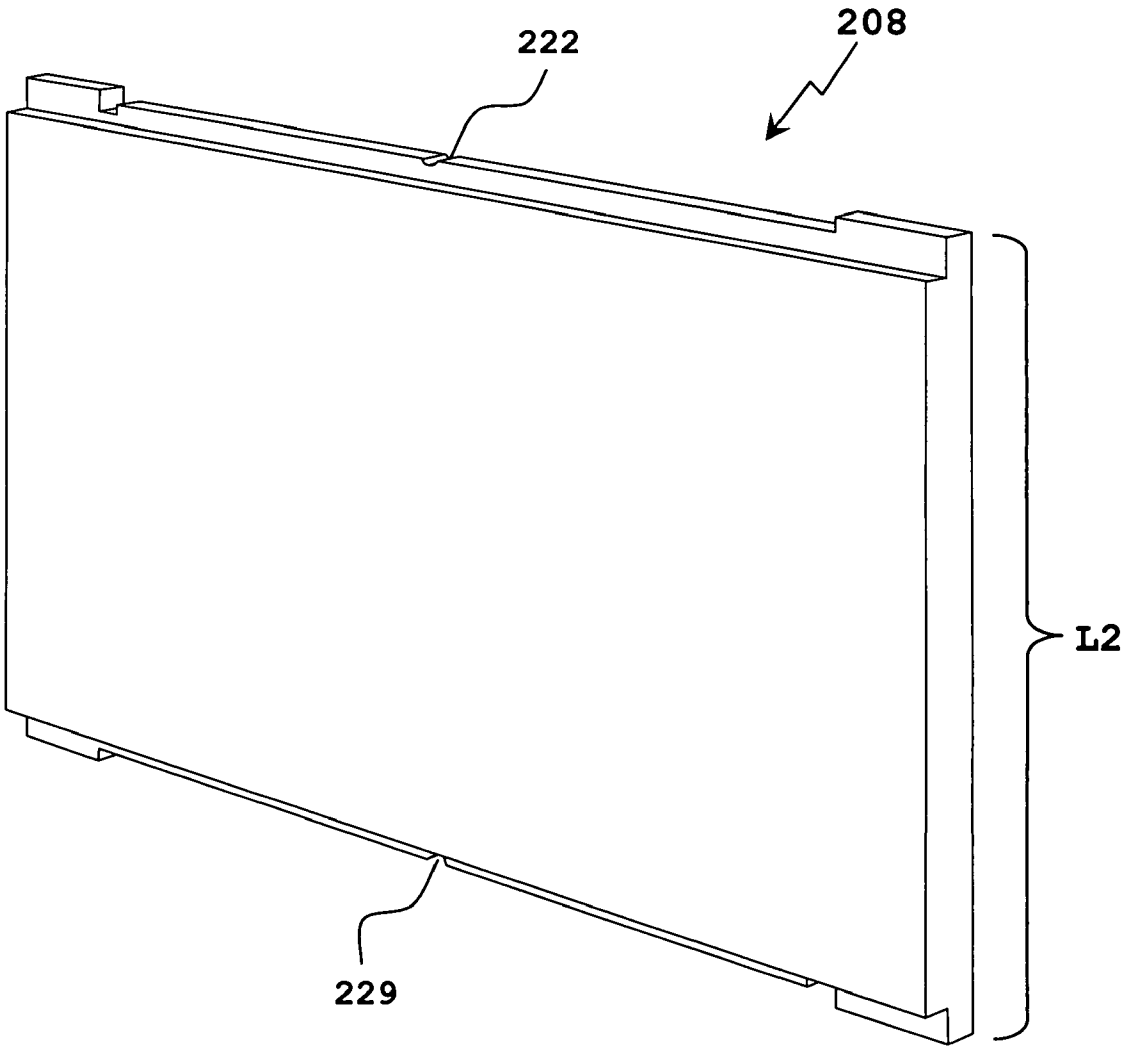
FIG. 9 shows a front perspective view of the front plate, illustrating the grooves therein.

As shown in FIG. 6, the header member 202 may further include a first locking member 203 for fitting within a groove 222 (see FIG. 9) etched on the front plate 208 for providing a tactile feedback and/or audio feedback (e.g. a clicking sound) indicating that the front plate 208 is properly positioned or centered between the header member 202 and the footer member 204. For example, the groove 222 may be etched into the center of the front plate 208, as shown in FIG. 9. The front plate 208 may then slide within the first track 231 of the holder 200 until tactile and/or audio feedback is generated by the first locking member 203 engaging the groove 222. In this manner, the front plate 208 may slide into a closed position to enable the sheet of material 210 to be properly displayed therethrough. The front plate 208 may also slide within the first track 231 in an outward direction until tactile and/or audio feedback is generated by the first locking member 203 engaging grooves 222 positioned on either end of the front plate 208. In this manner, the front plate 208 may slide into an open position to enable insertion or removal of the sheet of material 210, as illustrated in FIG. 4. As would be understood by those skilled in the art, the bias of the first locking member 203 engaging the groove 222 may be overcome with minimal force to slide the front plate 208 within the first track 231 further in the outward direction until completely removed from the holder 200. In this manner, the front plate 208 and/or the sheet of material may be removed and/or replaced, changed, cleaned, etc.

As shown in FIG. 7, the footer member 204 may further include a flexible lower cross brace 225 and an upper cross brace 223 which may further include a through-hole 205 on a top side thereof for receiving a fastening member 207 therein. The through-hole 205 is defined by a support member 332 positioned between the upper cross brace 223 and the lower cross brace 225 for supporting the fastening member 207 therein. The fastening member 207 is used to secure the front plate 208 between the header member 202 and the footer member 204 in a desired position. In use, rotation of the fastening member 207 may be used to cause an end of the fastening member 207 to push against the lower cross brace 225 having a second locking member 227 thereon. The force imparted on the lower cross brace 225 causes the lower cross brace 225 to push the second locking member 227 towards the front plate 208 and engage a groove 229 (see FIG. 9) etched on the front plate 208 to fixedly hold the front plate 208 in position. Reversed rotation of the fastening member 207 may be used to allow the lower cross brace 225 to return to a relaxed state and cause the second locking member 227 to disengage the groove 229 thereby unlocking the front plate 208. The front plate 208 can then freely slide in either direction within the first track 231, as discussed above.

Similarly, as discussed above with regard to the groove 222 and the first locking member 203, the front plate 208 may be slid within the first track 231 in the outward direction until tactile and/or audio feedback is generated by the second locking member 227 engaging grooves 229 positioned on either end of the front plate 208. Rotation of the fastening member 207 causes the fastening member 207 to forcibly engage the lower cross brace 225 causing the lower cross brace 225 to push the second locking member 227 towards the front plate 208 and engage the footer groove 229 positioned on either end of the front plate 208 to fixedly hold the front plate 208 in position. In this manner, the front plate 208 may be locked in an open position to enable insertion or removal of the sheet of material 210, as shown in FIG. 4. As discussed above, if the fastening member 207 is rotated in the opposite direction, the lower cross brace 225 is returned to a relaxed state such that the second locking member 227 disengages from the groove 229 and unlocks the front plate 208. The front plate 208 can then freely slide from an open position in either direction within the first track 231 (e.g., back to a closed position or in the outward direction to enable removal of the front plate 208 from the holder 200). The fastening member 207 may be, for example, a screw, slide pin, bolt, etc.

The holder 200 may be packaged as a kit having the header member 202, the footer member 204, several front plates 208 and several back plates 206 to allow for interchangeability. The front plates 208 and back plates 206 can have different sizes and colors, including multi-colored, clear (transparent), or opaque for enabling the removal of the front plate 208 and back plate 206 to be replaced with another from the kit.

Figure 8:
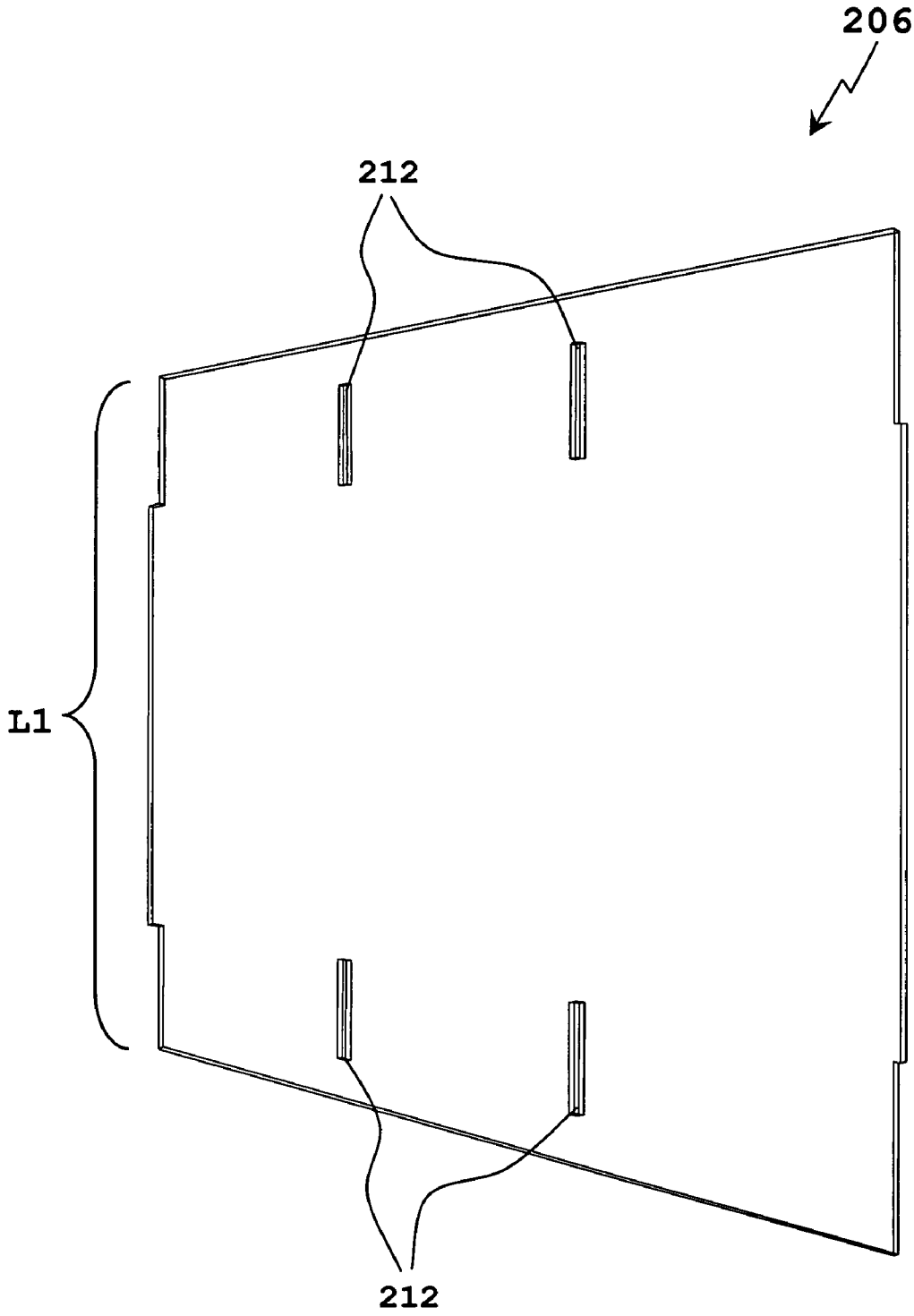
FIG. 8 shows a perspective view of the back plate shown in FIG. 2, illustrating the vertical dimension of the back plate and the openings included thereon.

As shown in FIGS. 8-9, the back plate 206 has a vertical length L1 and the front plate 208 has a vertical length L2. With the holder 200 of the present invention, it is possible to alter the vertical length L1 of the back plate 206 and the vertical length L2 of the front plate 208 to enable size variations of the holder 200. In this manner, the vertical dimension of the display area A may vary depending on the size of the front plate 208 and back plate 206 chosen from the kit. As would be understood by those skilled in the art, altering the vertical dimension of the holder 200 may be achieved without altering the dimensions of the header member 202 or the footer member 204. Alternately, additional size variations in the kit are envisioned, for example, varied horizontal dimensions of the back plate 206, front plate 208, header member 202, and footer member 204, etc.

It will be appreciated that various presently unforeseen or unanticipated alternatives, modifications, variations or improvements therein may be subsequently made by those skilled in the art which are also intended to be encompassed by the following claims.

What is claimed is:

1. A holder for displaying a sheet of material, the holder comprising:

a removable back plate;

a removable front plate;

a display area defined by the removable front plate configured to display a sheet of material; and a bracket having one or more components configured to support the removable back plate and removable front plate and configured to define a recess dimensioned to receive the sheet of material therebetween;

wherein the one or more components of the bracket include a header member and a footer member, the header member being separate, distinct, and disjoined from the footer member;

wherein the header member and the footer member each envelop a portion of the removable front plate and the removable back plate, such that the sheet of material is received on either end of the display area without removing the header and footer members;

wherein the header member and the footer member each include a pair of flanges configured to interface and support the removable back plate, the pair of flanges of the header member and the footer member forming at least a first track portion for receiving the removable back plate therein, wherein the header member includes a pair of first protrusion members each having a partial angled portion and the footer member includes a pair of second protrusion members each having a partial angled portion, the angled portions of the pair of first and second protrusion members configured to be received by openings on the removable back plate, securing thereby the removable back plate to the header and footer members, wherein at least a second track portion is formed between the header member and the footer member for receiving the removable front plate therein, the removable front plate sliding along the at least second track portion between a first position wherein the entire display area defined by the removable front plate extends over the removable back plate to a second position wherein a portion of the display area extends over the removable back plate and a portion of the display area extends beyond the removable back plate.

2. The holder according to claim 1, wherein the bracket includes a plurality of minor extensions projecting therefrom configured to support the back plate.

3. The holder according to claim 1, wherein the sheet of material includes indicia thereon.

4. The holder according to claim 1, wherein the front plate is substantially transparent.

5. The holder according to claim 1, wherein the front plate is a magnifying lens.

6. The holder according to claim 1, wherein the front plate is tinted.

7. The holder according to claim 1, wherein the back plate is transparent.

8. The holder according to claim 1, wherein the back plate is tinted.

9. The holder as defined in claim 1, wherein the footer member includes a through-hole element defined therein configured to receive a fastening member therethrough and enable securement of the front plate in a plurality of positions within the bracket.

10. The holder according to claim 1, wherein a front surface of the display area is flush with a front surface of at least one of the header member and the footer member.

11. A holder for displaying a sheet of material, the holder comprising:

a removable back plate;

a removable front plate;

a display area defined by the removable front plate configured to display a sheet of material; and a bracket having one or more components configured to support the removable back plate and removable front plate and configured to define a recess dimensioned to receive the sheet of material, wherein the bracket includes a header member and a footer member, the header member includes a first locking member and the footer member includes a second locking member, the first and second locking members are configured to secure the removable front plate in any one of a plurality of positions;

wherein the one or more components of the bracket include the header member and the footer member, the header member being separate, distinct, and disjoined from the footer member;

wherein the header member and the footer member each envelop a portion of the removable front plate and the removable back plate, such that the sheet of material is received on either end of the display area without removing the header and footer members;

wherein the header member and the footer member each include a pair of flanges configured to interface and support the removable back plate, the pair of flanges of the header member and the footer member forming at least a first track portion for receiving the removable back plate therein, wherein the header member includes a pair of first protrusion members each having a partial angled portion and the footer member includes a pair of second protrusion members each having a partial angled portion, the angled portions of the pair of first and second protrusion members configured to be received by openings on the removable back plate, securing thereby the removable back plate to the header and footer members, and wherein at least a second track portion is formed between the header member and the footer member for receiving the removable front plate therein, the removable front plate sliding along the at least a second track portion between a first position wherein the entire display area defined by the removable front plate extends over the removable back plate to a second position wherein a portion of the display area extends over the removable back plate and a portion of the display area extends beyond the removable back plate.

12. The holder as defined in claim 11, wherein the front plate includes at least one groove defined therein configured to engage the first and second locking members.

13. The holder as defined in claim 11, wherein at least one of a tactile and audio indication is provided when the at least one of the first and second locking member engage the at least one groove on the front plate signaling a desired position of the front plate within the bracket.

14. The holder as defined in claim 11, wherein the footer member includes a through-hole element defined therein configured to receive a fastening member therethrough and enable securement of the front plate in a plurality of positions within the bracket.

15. The holder as defined in claim 11, wherein a front surface of the display area is flush with a front surface of at least one of the header member and the footer member.

16. A kit for displaying a sheet of material, comprising:

at least one holder comprising:

a removable back plate;

a removable front plate;

a display area defined by the removable front plate, and configured to display a sheet of material; and a bracket having one or more components configured to support the removable back plate and removable front plate and configured to define a recess dimensioned to receive the sheet of material, wherein the bracket includes a header member and a footer member, the header member includes a first locking member and the footer member includes a second locking member, the first and second locking members are configured to secure the removable front plate in any one of a plurality of positions;

wherein the one or more components of the bracket include a header member and a footer member, the header member being separate, distinct, and disjoined from the footer member;

wherein the header member and the footer member each envelop a portion of the removable front plate and the removable back plate, such that the sheet of material is received on either end of the display area without removing the header and footer members;

wherein the header member and the footer member each include a pair of flanges configured to interface and support the removable back plate.

the pair of flanges of the header member and the footer member forming at least a first track portion for receiving the removable back plate therein, wherein the header member includes a pair of first protrusion members each having a partial angled portion and the footer member includes a pair of second protrusion members each having a partial angled portion, the angled portions of the pair of first and second protrusion members configured to be received by openings on the removable back plate, securing thereby the removable back plate to the header and footer members, and wherein at least a second track portion is formed between the header member and the footer member for receiving the removable front plate therein, the removable front plate sliding along the at least a second track portion between a first position wherein the entire display area defined by the removable front plate extends over the removable back plate to a second position wherein a portion of the display area extends over the removable back plate and a portion of the display area extends beyond the removable back plate.

17. The kit as defined in claim 16, wherein the front plate includes at least one groove defined therein configured to engage the first and second locking members.

18. The kit as defined in claim 17, wherein a tactile and/or audio indication is provided when the first and/or second locking member engage the at least one groove on the front plate, signaling a desired position of the front plate within the bracket.

19. The kit as defined in claim 18, wherein the footer member includes a through-hole element defined therein configured to receive a fastening member therethrough and enable securement of the front plate in a plurality of positions within the bracket.

20. The kit as defined in claim 16, wherein several back plates are included to allow for replacement thereof.

21. The kit as defined in claim 20, wherein the back plates are provided in multiple sizes and different colors, including multi-color and clear, for enabling replacement thereof.

22. The kit as defined in claim 16, wherein several front plates are included to allow for interchangeability.

23. The kit as defined in claim 22, wherein the removable front plates are provided in multiple sizes and different colors, including multi-color and clear, for enabling replacement thereof.

24. The kit as defined in claim 16, wherein a front surface of the display area is flush with a front surface of at least one of the header member and the footer member.

25. A holder for displaying a sheet of material, the holder comprising:

a removable back plate;

a removable front plate;

a display area defined by the removable front plate configured to display a sheet of material; and a bracket having one or more components configured to support the removable back plate and removable front plate and configured to define a recess dimensioned to receive the sheet of material there between;

wherein the bracket is U-shaped thereby providing a U-shaped edge to said bracket;

wherein the one or more components of the bracket include a header member and a footer member, the header member being separate, distinct, and disjoined from the footer member;

wherein the header member and the footer member each envelop a portion of the removable front plate and the removable back plate, such that the sheet of material is received on either end of the display area without removing the header and footer members;

wherein the header member and the footer member each include a pair of flanges configured to interface and support the removable back plate, the pair of flanges of the header member and the footer member forming at least a first track portion for receiving the removable back plate therein, wherein the header member includes a pair of first protrusion members each having a partial angled portion and the footer member includes a pair of second protrusion members each having a partial angled portion, the angled portions of the pair of first and second protrusion members configured to be received by openings on the removable back plate, securing thereby the removable back plate to the header and footer members, and wherein at least a second track portion is formed between the header member and the footer member for receiving the removable front plate therein, the removable front plate sliding along the at least a second track portion between a first position wherein the entire display area defined by the removable front plate extends over the removable back plate to a second position wherein a portion of the display area extends over the removable back plate and a portion of the display area extends beyond the removable back plate.

26. The holder as defined in claim 25, wherein the footer member includes a through-hole element defined therein configured to receive a fastening member therethrough and enable securement of the front plate in a plurality of positions within the bracket.

27. The holder as defined in claim 25, wherein a front surface of the display area is flush with a front surface of at least one of the header member and the footer member.

* * * * *